US005224840A

United States Patent [19]

Dreiman et al.

[11] Patent Number: 5,224,840

[45] Date of Patent: Jul. 6, 1993

[54] INTEGRAL SUCTION SYSTEM

[75] Inventors: Nelik I. Dreiman, Tipton; Robert D. Leffingwell, Hudson, both of Mich.

[73] Assignee: Tecumseh Products Company, Tecumseh, Mich.

[21] Appl. No.: 962,062

[22] Filed: Oct. 16, 1992

Related U.S. Application Data

[63] Continuation of Ser. No. 676,959, Mar. 28, 1991, abandoned.

[51] Int. Cl.[5] ..... F04B 39/00

[52] U.S. Cl. ..... 417/312; 181/403

[58] Field of Search ..... 417/312, 313, 373, 366, 417/371, 902; 181/403, 240, 246, 238, 339

[56] References Cited

U.S. PATENT DOCUMENTS

| | | | |
|---|---|---|---|
| 1,187,031 | 6/1913 | Black | 417/415 |
| 3,239,132 | 3/1966 | Frank | 417/371 |
| 4,033,707 | 7/1977 | Stutzman | 417/312 |
| 4,239,461 | 12/1980 | Elson | 417/312 |
| 4,239,461 | 12/1980 | Elson | 412/312 |
| 4,352,642 | 10/1982 | Murayama et al. | 417/312 |
| 4,370,104 | 1/1983 | Nelson et al. | 417/312 |
| 4,371,319 | 2/1983 | Murayama et al. | 417/312 |
| 4,401,418 | 8/1983 | Fritchman | 417/312 |
| 4,411,600 | 10/1983 | Itagaski et al. | 417/312 |
| 4,415,060 | 11/1983 | Bar | 181/403 |
| 4,449,610 | 5/1984 | Bar | 181/403 |
| 4,477,229 | 10/1984 | Kropiwnicki et al. | 417/53 |
| 4,487,555 | 12/1984 | Ohinata | 417/312 |
| 4,492,533 | 1/1985 | Tsuge | 417/415 |
| 4,573,880 | 3/1986 | Hirano et al. | 417/312 |
| 4,573,881 | 3/1986 | Romer | 417/312 |
| 4,755,108 | 7/1988 | Todescat et al. | 417/312 |
| 4,779,415 | 10/1988 | Richardson | 181/240 |
| 4,784,581 | 11/1988 | Fritchman | 417/312 |
| 4,784,583 | 11/1988 | Bar | 417/312 |
| 4,793,775 | 12/1988 | Peruzzi | 417/312 |
| 4,995,791 | 2/1991 | Loprete | 417/366 |

FOREIGN PATENT DOCUMENTS

| | | |
|---|---|---|
| 86/2004223 | 3/1985 | European Pat. Off. . |
| 53-103209 | 9/1978 | Japan . |
| 56-14878 | 2/1981 | Japan . |
| 56-60883 | 5/1981 | Japan . |
| 60-73072 | 4/1985 | United Kingdom . |

*Primary Examiner*—Richard A. Bertsch
*Assistant Examiner*—Peter Kurytnyk
*Attorney, Agent, or Firm*—Baker & Daniels

[57] ABSTRACT

A gas flow system for a hermetic compressor is described which reduces the transfer of heat from the cylinder head and the hot discharge gases along with other hot internal compressor parts, wherein a separately formed suction tube is made from a low thermal conductivity plastic and is adapted to be received in a separately formed cylinder head. The cylinder head includes discharge chambers formed integrally therein but is adapted to receive the suction tube, while the suction tube includes a conduit defining a suction plenum having a suction inlet and adjutages extending transverse to the conduit which extend to the valve plate and communicate with openings in the cylinder head in order that the refrigerant flowing therein bypass the hot cylinder head and flows directly into the cylinder. The gas flow system also provides cooling for the motor in which a part of the refrigerant which flows into the suction tube is directed through the motor. Grooves formed in the cylinder head walls accommodate O-rings that allow a press fit of the suction tube onto the cylinder head.

18 Claims, 4 Drawing Sheets

INTEGRAL SUCTION SYSTEM

This is a continuation of application Ser. No. 07/676,959, filed Mar. 28, 1991 now abandoned.

BACKGROUND OF THE INVENTION

The present invention relates to hermetic compressors and, more particularly, to a suction system for a hermetic compressor.

Hermetic compressors are utilized for circulating a refrigerant gas through a closed refrigerant system. In operation, the refrigerant vapor is fed into the interior of the compressor through an intake pipe in the sealed housing defining the compressor. Once inside the compressor, the refrigerant vapor is introduced into a compressor cylinder wherein the vapor is compressed by a piston within the cylinder resulting in an increase in temperature. The vapor exits the cylinder through an exhaust valve, consequently flowing into the discharge portion of the compressor to circulate through the external refrigerant system to return to the compressor unit.

Present practice requires that the design of compressors be as compact as possible, thus the limited available space within the compressor assembly imposes severe size constraints for the suction assembly as well as the discharge elements. Because of this, it is necessary to extend the internal suction system elements, e.g. mufflers, conduits, cavities, in close proximity to other compressor parts that generate and transmit heat.

In the design of high efficiency compressors it is also important to reduce or eliminate noise generated by the suction process. In this regard, some hermetic motor compressors employ a shroud over the open end of the motor assembly to attenuate suction noise generated by pressure pulsations produced by the compressor.

In addition, it is necessary to limit or eliminate the transfer of heat from hot compressor parts such as the wall of the housing, the discharge system, the cylinder block, and the oil, to the relatively cooler intake gas. The intake gas must remain cool to facilitate compressor operation, as overheated intake gas causes an increase in compressor work due to the lowering of the specific gravity of the intake gas reducing the amount of gas entering the cylinder chamber.

Various provisions have been made by the prior art to rectify these problems, such as an intake pipe for the motor compressor being directly connected to a suction muffler of a cylinder head, and within the sealed housing, the intake opening of the suction muffler or suction conduit being disposed as opposed to the tip end of the intake pipe at a minimum distance, or a muffler shell and conduit being formed from a plastic material of low thermal conductivity to minimize heat transfer to the suction gas. Bypass suction conduits, often equipped with the suction mufflers, have also been provided to give continuous unrestricted fluid passageway for suction gas from the motor shroud or from the intake pipe to the suction cavities in the cylinder head.

Commonly, compressor cylinder heads for handling the gas flow for both the discharge and suction sides are manufactured from cast iron or aluminum to provided side-by-side or adjacent suction and discharge cavities separated by dividing walls which were preferably made as thin as possible to allow a maximum suction and discharge plenum volume in the limited amount of available space. In addition, some efforts to overcome the overheating of the suction gas in the cylinder head suction plenum have resulted in tubular liners fabricated from a low thermal conductivity plastic preventing heat transfer to the suction gas, eliminating the suction plenum in the cylinder head and attaching a suction conduit to the relatively thin valve plate, or manufacturing the suction muffler out of a low thermal conductivity plastic. Further arrangements have included utilizing separate discharge and suction cylinder heads for the discharge and suction chambers while the suction cylinder head is formed of a plastic material of low thermal conductivity to minimize heat transfer between the suction and discharge cylinder heads.

However, even with these modifications, the compressors in the prior art are often not acceptable because of various disadvantages such that the transmission of vibration from the compressor to the external piping was increased and that prevention of overheating of the suction ga in the suction cavities of the cylinder head was not sufficient. In addition, these modifications have increased restrictions on the flow of suction gas at the suction port because of the reduced cross-sectional area or the lack of an immediately adjacent suction plenum, also consequently increasing the noise level.

For larger refrigeration and air conditioning single and multi cylinder compressors, such modifications are often not acceptable because of certain disadvantages such as complexity, dimensions of the suction system and discharge system with larger contact areas for the materials with different coefficients of expansion due to heat, limited space, higher oscillation forces of the suction system element due to pressure pulsations, difficulties on assembly, and higher costs.

SUMMARY OF THE INVENTION

The present invention provides, in a compressor, a one-piece integral suction adaptor accommodating suction porting while defining a suction plenum, disposed on a cylinder head defining separate discharge chambers and porting, which draws suction gas from the interior of the compressor housing. The suction adaptor also includes suction porting communicating with a passage in the cylinder block allowing gas to flow through the motor to effect cooling thereof while providing a continuous circulating flow of refrigerant gas into the integral suction adaptor.

The present invention, in one form thereof, provides a one-piece integral suction adaptor disposed on the cylinder head in which a main portion of the refrigerant gas is drawn from the interior of the compressor housing located in the close proximity of the compressor housing intake pipe, or intermediate suction muffler between the intake pipe and the integral suction adaptor, while another portion of the refrigerant gas is drawn through the motor rotor-stator gap to effect cooling of the motor thereof.

The integral suction adaptor is constructed such that there is a continuous flow of the refrigerant gas through the motor rotor-stator gap necessary for motor cooling, and this portion of refrigerant gas combined with the main portion of the refrigerant gas is delivered to one of the cylinders without contacting any hot surface of the cylinder head or other parts. The integral suction adaptor is preferably made from plastic to reduce the transfer of heat from the compressor parts and walls of the housing to the intake refrigerant gas. The exterior walls of the discharge cavities of the cylinder head adjacent to the exterior walls of the suction plenums of the integral suction adaptor are spaced from each other to provide an additional thermal barrier and further reduce suction gas heating in the cavities and passage of the cylinder head and integral suction adaptor. O-rings are disposed in grooves within the space between the exterior walls of the discharge cavities of the cylinder head and the exterior walls of the suction plenums of the integral suction adaptor allowing a press-fit joining of the integral suction adaptor onto the cylinder head providing vibration dampening while effecting sealing.

A gas flow system comprises a cylinder head disposed on the valve plate having walls defining a closed discharge chamber, motor cooling means for cooling the motor by flowing refrigerant through said motor, and a low thermal conductivity suction tube defining a suction plenum disposed on said cylinder head having a suction inlet port in fluid communication with the internal low pressure cavity, including an elongate conduit and a first adjutage extending through said cylinder suction opening and extending to the valve plate (but not interfering with it) for bypassing the cylinder head, a motor flowthrough opening communicating with said internal low pressure cavity and adapted to receive refrigerant from the motor cooling means.

It is thus an object of the present invention to minimize the transfer of heat from the discharge cavities in a cylinder head having discharge plenums formed integrally therein and separated by internal walls to the suction plenums of the integral suction adaptor and refrigerant gas entering therein.

It is further an object of the present invention to combine delivery of the refrigerant gas intended to cool the motor and the suction gas delivered to the cylinder suction chamber from the interior of the compressor housing located in the close proximity of the intake pipe.

It is still further an object of the present invention to minimize the transfer of heat to the suction ga from all internal compressor parts.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

DESCRIPTION OF THE PREFERRED EMBODIMENT

Figure 1:
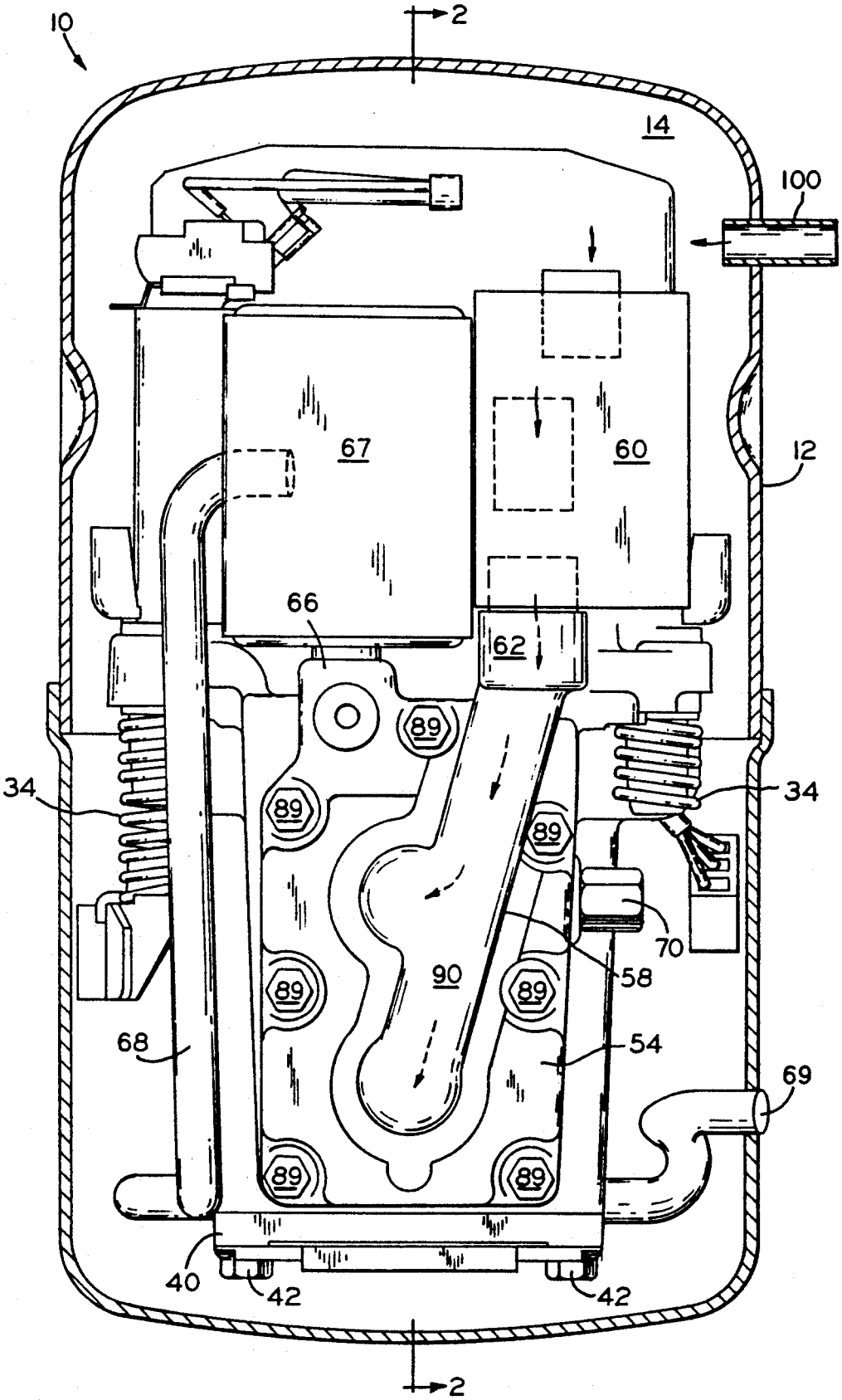
FIG. 1 is an elevational view, partly in section, of a compressor incorporating a preferred embodiment of the present invention.
Figure 2:
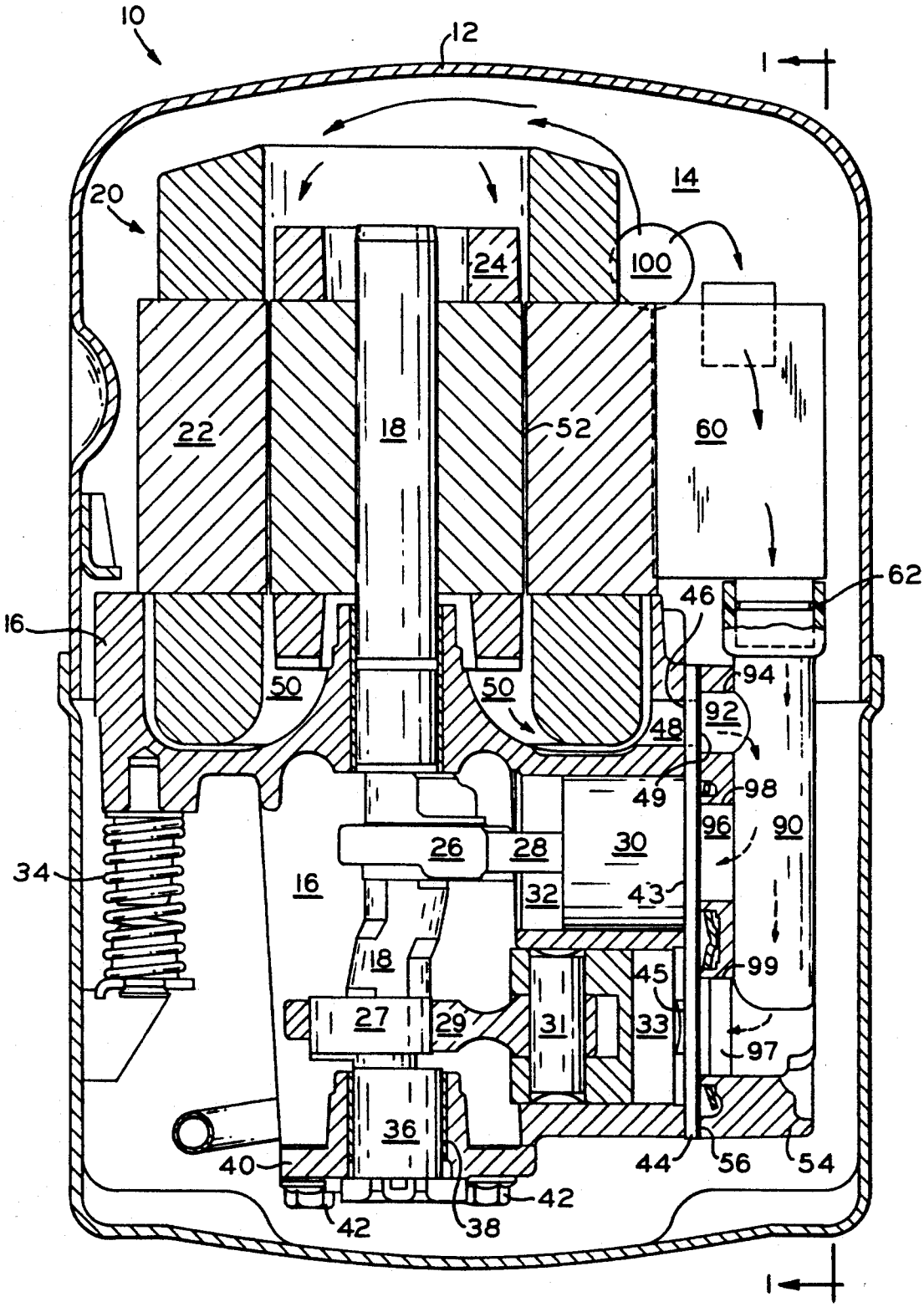
FIG. 2 is an elevational sectional view of a compressor incorporating a preferred embodiment of the present invention taken along line 2—2 of FIG. 1.

Referring to the drawings, and in particular to FIGS. 1 and 2, there is shown a hermetically sealed, reciprocating piston compressor 10 embodying the present invention. Compressor 10 includes a sealed compressor housing 12 encapsulating the remainder of the compressor components and defining an internal, low pressure cavity 14. Disposed within housing 12 is a cylinder block 16 supporting a crankshaft 18 which is driven by a motor 20 which includes a stator 22 and rotor 24 each having windings thereon. Shock mounts 34 attached to cylinder block 16 and housing 12 suspend the compressor components within housing 12.

By way of illustration, and without any limitation on the invention, orientation of compressor 10 in the illustrated preferred embodiment is with cylinder block 16 suspended vertically beneath motor 20. However, other orientations of the compressor components are contemplated and fall within the scope and spirit of the present invention.

Attached to crankshaft 18 within cylinder block 16 are crankpins 26 and 27, respectively connected to connecting rods 28 and 29, which are in turn respectively connected to pistons 30 and 31, within respective cylinders 32 and 33. The lower end 36 of crankshaft 18 is radially surrounded by bushing 38 in outboard bearing 40 which is fixedly mounted to cylinder block 16 by bearing bolts 42.

A valve plate 44 is disposed o the end of cylinders 32 and 33 and supports the suction and discharge valving (not shown) to and from the cylinders. Valve plate 44 includes a suction aperture 46 (FIG. 2) communicating with a cylinder block passage 48 adjacent stator 22 of motor 20. Valve plate 44 also includes cylinder suction apertures 43 and 45 respectively communicating with cylinders 32 and 33. Cylinder block passage 48 communicates with stator/rotor cavity 50 and stator/rotor gap 52 to provide a continuous suction path through the stator/rotor gap 52 effecting cooling of motor 20 and providing an additional suction source. A cylinder head 54 is mounted over valve plate 44 separated by a gasket 56. In accordance with the present invention, an integral suction adaptor 58 (to be described in detail hereinbelow) is disposed on cylinder head 54 and is connected to suction muffler 60 by way of suction connector 62.

Figure 3:
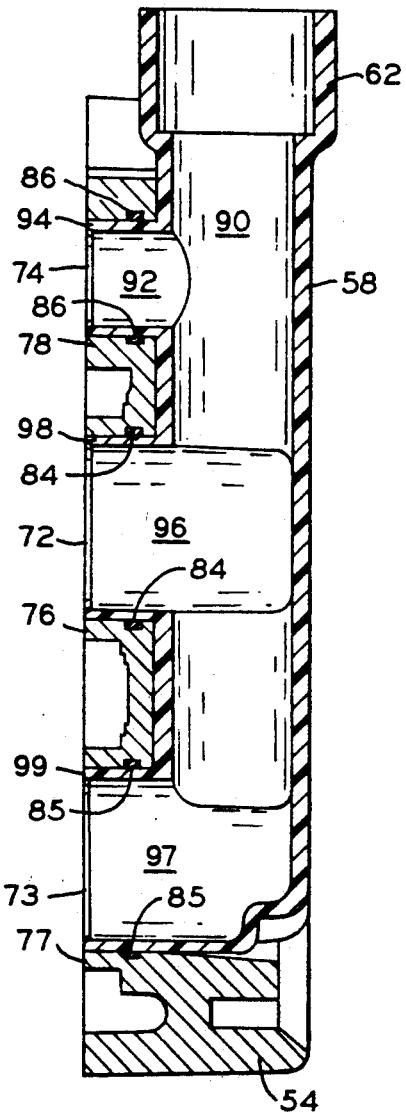
FIG. 3 is a sectional view of the cylinder head and integral suction adaptor assembly of the present invention taken along line 3—3 of FIG. 4.
Figure 4:
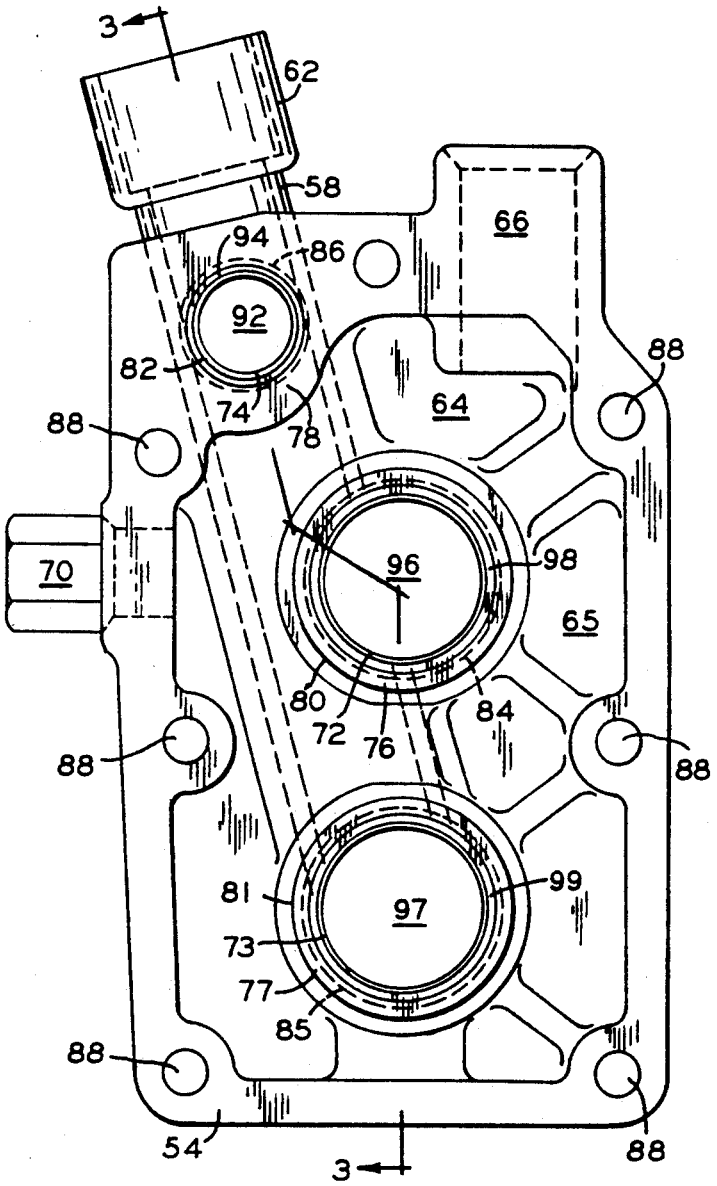
FIG. 4 is a bottom view of the cylinder head and integral suction adaptor assembly of the present invention.

As best shown in FIGS. 3 and 4, integrally formed in cylinder head 54 are discharge cavities 64 and 65 which communicate with discharge port 66, discharge muffler 67, discharge tube 68, and outlet 69 (see FIG. 1). A pressure relief valve 70 is also in communication with discharge cavities 64 and 65 should excess pressure in cylinder head 54 require venting. In addition, integrally formed in cylinder head 54 are cylinder suction openings 72 and 73, and a rotor/stator flowthrough suction opening 74 separated from the high pressure discharge cavities 64 and 65 by cylindrical cylinder head walls 76, 77, and 78 respectively. Cylinder suction openings 72 and 73 are disposed over cylinders 32 and 33, respectively, while rotor/stator flowthrough suction opening 74 is disposed over cylinder block passage 48 so as to allow suction gas entry flowing through motor 20. Formed in the inside of cylinder head walls 76, 77, and 78 defining cylinder suction openings 72 and 73, and rotor/stator suction opening 74 respectively, are respective circular grooves 80, 81, and 82 designed to respectively accommodate O-rings 84, 85, and 86 made of a refrigerant and oil resistant material such as polytetrafluoroethylene, although other known materials may be used. In addition, cylinder head 54 also includes bolt holes 88 in which bolts 89 (shown in FIG. 1) are accommodated in order to secure cylinder head 54 to cylinder block 16.

Figure 5:
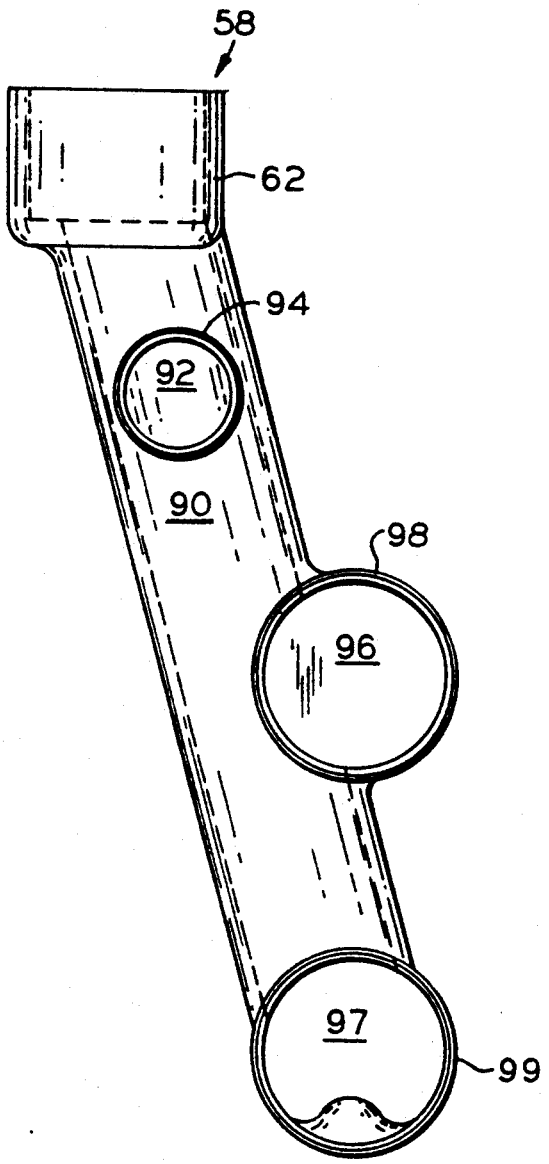
FIG. 5 is a bottom view of the integral suction adaptor of the present invention.
Figure 6:
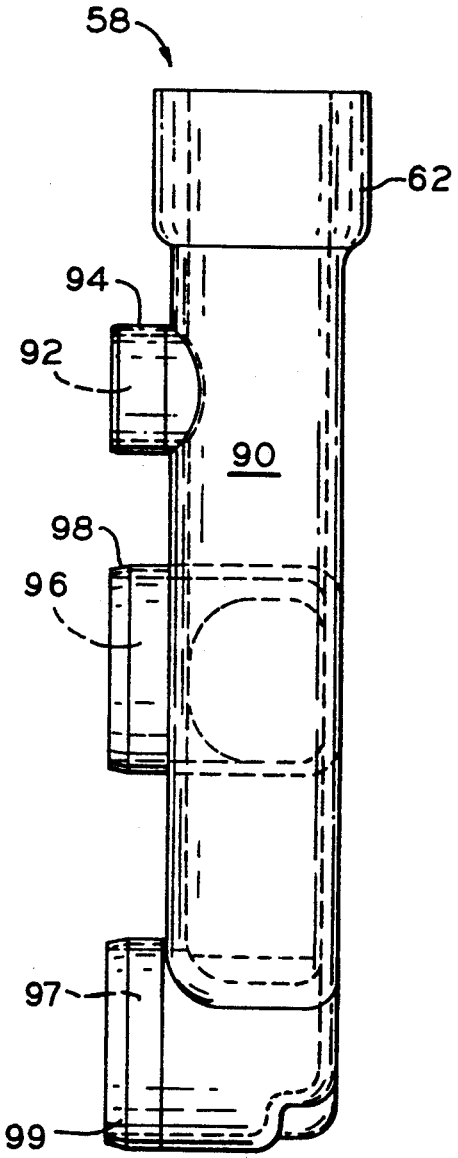
FIG. 6 is a side elevational view of the integral suction adaptor of the present invention.

In accordance with the present invention, and with additional reference to FIGS. 5 and 6, there is shown the integral suction adaptor 58 of the present invention. Integral suction adaptor 58 is made from a thermally low conductivity plastic such as Nylon ® or Valox ®, although other known thermally low conductivity plastics or materials may be utilized, in order to reduce the transfer of heat to the intake refrigerant gas from the compressor parts and walls of the housing. Integral suction adaptor 58 includes suction connector 62 integral with a tubular-like conduit 90 defining a suction plenum. Along the longitudinal length of conduit 90 nearest suction connector 62 is a rotor/stator suction port 92 defined by a circular protruding wall 94 radially extending from conduit 90 and which is adapted to be received through rotor/stator suction opening 74 of cylinder head 54. Likewise, along the longitudinal length of conduit 90 are two cylinder intake ports 96 and 97 defined by adjutages 98 and 99 radially extending from conduit 90 and which are adapted to be respectively received through cylinder suction openings 72 and 73 of cylinder head 54. It is to be noted, however, that the integral suction adaptor 58 can be modified to accommodate a one cylinder compressor by having only one cylinder intake port defined by one adjutage.

As best shown in FIG. 3, integral suction adaptor 58 is coupled to cylinder head 54 by fitting the radially extending ports 92, 96, and 97, which preferably extend (but not interfere) substantially to the surface 49 of valve plate 44, respectively into rotor/stator suction opening 74 and cylinder intake ports 96 and 97, being held into place by O-rings 86, 84, and 85. By reason of the resilience of the O-rings, the integral suction adaptor 58 can be slightly displaced to all sides in a plane perpendicular to the axes of cylinders 32 and 33. This connection feature also facilitates assembly because the integral suction adaptor 58 can be pushed in the cylinder head openings. In addition to the retention characteristics of the O-rings, the integral suction adaptor 58 can also be strapped across the cylinder head. The O-rings also act as damping elements which oppose the transmission of sounds and vibrations from cylinder head 54 to the thinner wall of the integral suction adaptor 58. In addition, the O-rings work as sealing elements which separate the interior of the rotor/stator suction port and the cylinder intake ports from the interior compressor cavity 14.

During operation of compressor 10, refrigerant enters housing 12 through inlet pipe 100. Because inlet pipe 100 opens into interior cavity 14 of housing 12, the compressor 10 of FIGS. 1 and 2 is a low back pressure compressor operating at suction pressure. The direction of refrigerant flow is depicted by arrows. The main portion of the intake refrigerant gas is drawn into suction muffler 60 and into plenum conduit 90 which is in fluid communication with cylinder intake ports 96 and 97 which are respectively arranged over and in fluid communication with cylinders 32 and 33. In addition, since integral suction adaptor is in fluid communication with cylinder block passage 48 via suction aperture 46 in valve plate 44 and rotor/stator suction port 72 of the integral suction adaptor 58, a portion of the refrigerant gas is drawn through the stator/rotor gap 52 into the stator/rotor cavity 50 to effect necessary cooling of motor 20, which also provides a continuous flow of refrigerant gas into plenum conduit 90 of the integral suction adaptor 58.

It will be appreciated that the foregoing description of a preferred embodiment of the present invention along with an alternative embodiment thereof, is presented by way of illustration only, and not by way of any limitation, and that various alternatives and modifications may be made to the illustrated embodiment without departing from the spirit and scope of the invention.

What is claimed is:

1. In a hermetic reciprocating piston compressor including a housing, an internal low pressure cavity defined by the housing, a cylinder block, a crankshaft, a valve plate disposed on said cylinder block, a motor having a rotor and a stator, and a cylinder in said cylinder block having a piston therein that reciprocates in an axial direction, a gas flow system comprising:

a cylinder head disposed on the valve plate axially outwardly of the cylinder, aid cylinder head having walls defining a closed discharge chamber in fluid communication with the cylinder and a discharge port in fluid communication with said discharge chamber, a cylinder suction opening axially outwardly disposed of the cylinder;

motor cooling means for cooling the motor by flowing refrigerant through said motor;

a low thermal conductivity suction tube defining a suction plenum disposed on said cylinder head having a suction inlet in fluid communication with the internal low pressure cavity, said suction tube including a conduit extending transverse to the axial direction of said cylinder, a first adjutage extending transverse to said conduit and extending through said cylinder suction opening, a motor flowthrough opening communicating with said internal low pressure cavity and adapted to receive refrigerant from said motor cooling means, said first adjutage extending substantially to said valve plate for substantially bypassing said cylinder head whereby the refrigerant flows directly to the cylinder.

2. The gas flow system of claim 1, wherein said motor cooling means comprises:

a suction passage formed in said cylinder block adjacent the stator, said suction passage in fluid communication with said motor flowthrough suction opening; and a rotor/stator gap defined by a space between the rotor and the stator, said gap in fluid communication with both the internal low pressure cavity and said suction passage.

3. The gas flow system of claim 1, wherein said motor flowthrough opening is in said cylinder head, and said suction tube further comprises a second adjutage extending transverse to said conduit and extending through said motor flowthrough opening.

4. The gas flow system of claim 1, wherein said suction tube is made from a thermally low conductivity plastic.

5. The gas flow system of claim 1, wherein said walls defining said cylinder suction opening and said motor flowthrough suction opening are each defined by a surface that includes a groove, wherein O-rings are disposed in said grooves.

6. In a hermetic reciprocating piston compressor for a refrigerant gas including a housing, an internal low pressure cavity defined by the housing, a cylinder block, a crankshaft, a valve plate disposed on said cylinder block, a motor having a stator and a rotor, and a plurality of parallel cylinders having a plurality of pistons disposed therein which reciprocate in an axial direction, a gas flow system comprising:

a cylinder head disposed on the valve plate axially outwardly of the cylinders having a discharge port and a plurality of discharge chambers defined by walls, said discharge chambers corresponding to the number of cylinders, said discharge chambers in fluid communication with the cylinders and said discharge port, said walls also defining a plurality of cylinder suction openings axially outwardly disposed over the cylinders;

a low thermal conductivity suction tube defining a suction plenum disposed on said cylinder head having a suction inlet in fluid communication with the internal low pressure cavity, said suction tube including an elongate conduit extending transverse to the axial direction of said cylinders, a plurality of first adjutages corresponding to the number of cylinders, said first adjutages extending transverse to said elongate conduit and extending through said plurality of cylinder suction openings, said plurality of first adjutages extending toward said valve plate but terminating short of extending into said valve plate for substantially bypassing said cylinder head whereby the refrigerant flows directly to the plurality of cylinders.

7. The gas flow system of claim 6, wherein said suction tube is made from a thermally low conductivity plastic.

8. The gas flow system of claim 6, wherein said walls defining said plurality of cylinder suction openings include grooves formed therein, wherein O-rings are disposed in said grooves.

9. The gas flow system of claim 6, wherein a first gap is defined between each said plurality of first adjutages and each said cylinder head walls which define said plurality of cylinder suction openings, each said first gap including an O-ring disposed therein for separating said adjutages from said walls defining said cylinder suction openings, whereby said adjutages are thermally and vibrationally isolated from said walls.

10. The gas flow system of claim 6, wherein a first gap is defined between each said plurality of first adjutages and said valve plate, said second gaps separating said adjutages from said valve plate, whereby said adjutages are thermally and vibrationally isolated from said valve plate.

11. In a hermetic reciprocating piston compressor for a refrigerant gas including a housing, an internal low pressure cavity defined by the housing, a cylinder block, a crankshaft, a valve plate disposed on said cylinder block, a motor having a stator and a rotor, and a plurality of parallel cylinders having a plurality of pistons disposed therein which reciprocate in an axial direction, a gas flow system comprising:

a cylinder head disposed on the valve plate axially outwardly of the cylinders having a discharge port and a plurality of discharge chambers defined by walls, said discharge chambers corresponding to the number of cylinders, said discharge chambers in fluid communication with the cylinders and said discharge port, said walls also defining a plurality of cylinder suction openings axially outwardly disposed over the cylinders;

motor cooling means for cooling the motor by drawing refrigerant through said motor; and a low thermal conductivity suction tube defining a suction plenum disposed on said cylinder head having a suction inlet in fluid communication with the internal low pressure cavity, said suction tube including an elongate conduit extending transverse to the axial direction of said cylinders, a plurality of first adjutages corresponding to the number of cylinders, said adjutages extending transverse to said elongate conduit and extending through said plurality of cylinder suction openings, said plurality of first adjutages extending substantially to said valve plate for substantially bypassing said cylinder head whereby the refrigerant flows directly to the plurality of cylinders, said suction tube including a motor flowthrough opening communicating with said internal low pressure cavity and adapted to receive refrigerant from said motor cooling means.

12. The gas flow system of claim 9, wherein said motor flowthrough opening is in said cylinder head, and said suction tube further comprising a second adjutage extending transverse to said elongate conduit and extending through said motor flowthrough opening.

13. In a hermetic reciprocating piston compressor for a refrigerant gas including a housing, a cylinder block, a crankshaft, a valve plate with a suction aperture and a plurality of cylinder suction apertures, a motor having a stator and a rotor, and a plurality of cylinders having a plurality of pistons disposed therein which reciprocate in an axial direction, a gas flow system comprising:

a cylinder head disposed on the valve plate axially outwardly of the cylinders having a discharge port and a plurality of discharge chambers defined by integrally formed walls corresponding to the number of cylinders, said discharge chambers in fluid communication with the cylinders and said discharge port, said integrally formed walls also defining a plurality of cylinder suction openings axially outwardly disposed over the cylinders and defining a motor flowthrough suction opening in fluid communication with said suction aperture in said valve plate;

motor cooling means in the cylinder block for cooling the motor with the refrigerant gas, said motor cooling means in fluid communication with said suction aperture in said valve plate; and a low thermal conductivity suction tube defining a suction plenum disposed on said cylinder head having a suction inlet transverse to the axial direction of said cylinders, a plurality of first adjutages corresponding to the number of cylinders, said adjutages extending transverse to said elongate conduit and extending towards said plurality of cylinder suction openings, a second adjutage extending transverse to said elongate conduit and extending toward said motor flowthrough suction opening, said plurality of first adjutages extending substantially to said plurality of cylinder apertures in said valve plate for substantially bypassing said cylinder head whereby the refrigerant flows directly to the plurality of cylinders, said second adjutage extending substantially to said suction aperture in said valve plate whereby a portion of the refrigerant is received from the motor.

14. The gas flow system of claim 13, wherein said suction tube is made from a thermally low conductivity plastic.

15. The gas flow system of claim 13, wherein said walls defining said plurality of cylinder suction openings include grooves formed therein, wherein O-rings are disposed in said grooves.

16. In a hermetic reciprocating piston compressor for a refrigerant gas including a housing, an internal low pressure cavity defined by the housing, a cylinder block, a crankshaft, a valve plate disposed on said cylinder block, a motor having a stator and a rotor, and a plurality of parallel cylinders having a plurality of pistons disposed therein which reciprocate in an axial direction, a gas flow system comprising:

a cylinder head disposed on the valve plate axially outwardly of the cylinders having a discharge port and a plurality of discharge chambers defined by walls, said discharge chambers corresponding to the number of cylinders, said discharge chambers in fluid communication with the cylinders and said discharge port, said walls also defining a plurality of cylinder suction openings axially outwardly disposed over the cylinders;

a low thermal conductivity suction tube defining a suction plenum disposed on said cylinder head having a suction inlet in fluid communication with the internal low pressure cavity, said suction tube including an elongate conduit extending transverse to the axial direction of said cylinders, a plurality of first adjutages corresponding to the number of cylinders, said first adjutages extending transverse to said elongate conduit and extending through said plurality of cylinder suction openings being retained thereby, said plurality of first adjutages extending toward said valve plate for substantially bypassing said cylinder head whereby the refrigerant flows directly to the plurality of cylinders.

17. The gas flow system of claim 16, wherein a first gap is defined between each said plurality of first adjutages and each said cylinder head walls which define said plurality of cylinder suction openings, each said first gap including an O-ring disposed therein for separating said adjutages from said walls defining said cylinder suction openings, whereby said adjutages are thermally and vibrationally isolated from said walls.

18. The gas flow system of claim 16, wherein a first gap is defined between each said plurality of first adjutages and said valve plate, said second gaps separating said adjutages from said valve plate, whereby said adjutages are thermally and vibrationally isolated from said valve plate.

* * * * *